United States Patent [19]

Focke et al.

[11] Patent Number: 4,947,617

[45] Date of Patent: Aug. 14, 1990

[54] APPARATUS FOR THE PRODUCTION OF HINGE-LID PACKS FOR CIGARETTES

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 299,156

[22] Filed: Jan. 19, 1989

[30] Foreign Application Priority Data

Jan. 29, 1988 [DE] Fed. Rep. of Germany ..... 3802644

[51] Int. Cl.[5] ..... B65B 19/20; B65B 49/12

[52] U.S. Cl. ..... 53/234; 53/202; 53/253; 53/575

[58] Field of Search ..... 53/575, 234, 230, 225, 53/207, 253, 252, 176, 202

[56] References Cited

U.S. PATENT DOCUMENTS

| | | | |
|---|---|---|---|
| 4,208,854 | 6/1980 | Seragnoli | 53/234 X |
| 4,358,920 | 11/1982 | Kanai et al. | 53/234 X |
| 4,559,757 | 12/1985 | Focke et al. | 53/234 X |
| 4,559,758 | 12/1985 | Gamberini | 53/234 X |

FOREIGN PATENT DOCUMENTS

| | | |
|---|---|---|
| 0078294 | 5/1983 | European Pat. Off. . |
| 0275481 | 7/1988 | European Pat. Off. . |
| 1052300 | 3/1959 | Fed. Rep. of Germany . |
| 2029903 | 12/1971 | Fed. Rep. of Germany . |
| 2440006 | 3/1976 | Fed. Rep. of Germany . |
| 2949252 | 6/1981 | Fed. Rep. of Germany . |
| 2858074 | 8/1985 | Fed. Rep. of Germany . |
| 3512611 | 10/1986 | Fed. Rep. of Germany . |
| 3536791 | 4/1987 | Fed. Rep. of Germany . |
| 1459091 | 12/1976 | United Kingdom . |
| 1525715 | 9/1978 | United Kingdom . |
| 1603073 | 11/1981 | United Kingdom . |
| 2134870 | 8/1984 | United Kingdom . |

*Primary Examiner*—James F. Coan

*Attorney, Agent, or Firm*—Sughrue, Mion, Zinn, Macpeak & Seas

[57] ABSTRACT

The performance of packaging machines for the production of hinge-lid cigarette packs is limited by complex folding operations. In particular, these packs have hitherto been conveyed through the packaging machine by intermittently moved conveying members (folding turrets), the necessary folding steps thereby being carried out. In order to increase the performance of a packaging machine of this type, folding turrets (35, 36) are driven continuously. During the continuous movement of folding turrets 35, 36, the necessary folding of pack blanks (12) are made, especially by means of co-rotating folding members assigned respectively to a pocket (47, 74) of the folding turrets. During the continuous run, partially finished hinge-lid packs (10) are transferred from one folding turret (35) to the following folding turret (36) which is designed in a similar way to the first folding turret (35) and which completes the folding of the pack blanks (12). To increase the performance even further, the packaging machine is operated in a two-track mode with folding turrets (35 and 36) designed as double turrets.

20 Claims, 9 Drawing Sheets

APPARATUS FOR THE PRODUCTION OF HINGE-LID PACKS FOR CIGARETTES

BACKGROUND OF THE INVENTION

The invention relates to an apparatus for the production of hinge-lid packs, especially for cigarettes, from a pack blank which can be folded round a (cigarette) block during transport by folding turrets, the pack blanks together with the cigarette block each being held in pockets of the folding turret and being foldable by means of folding members of fixed location connected to the folding turret.

Hinge-lid packs are in widespead use for receiving cigarettes. The hinge-lid pack is composed of a pack part and of a lid hinged on this in the region of a rear wall. The pack content, namely a cigarette group, is wrapped in an inner blank made of tin foil or the like and thus constitutes a cigarette block.

Packaging machines known in practice for the production of hinge-lid packs of this type are equipped with at least one folding turret which has pockets for receiving the pack blanks and the pack content. The folding turrets are driven intermittently, that is to say periodically. During the transport of the pack blanks by the folding turret, the necessary folding steps are carried out. The performance of packaging machines of this type is limited because of the periodic drive of the folding turret.

SUMMARY OF THE INVENTION

The object on which the invention is based is to propose an apparatus (packaging machine) for the production of hinge-lid packs, which, whilst ensuring careful treatment of the cigarettes, achieves a considerably higher performance, that is to say a higher output of hinge-lid packs per unit of time, than conventional packaging machines for this type of pack.

To achieve this object, the apparatus according to the invention is designed so that, in the region of a first folding turret, inner side tabs of a rear wall lying in the pocket of the folding turret and inner lid side tabs of a lid rear wall and a blank part consisting of a bottom wall and of a front wall, on the one hand, and a blank part consisting of a lid top wall and of a lid front wall, on the other hand, can be folded until they come up against the cigarette block. In the region of a second folding turret, outer side tabs of the front wall are foldable against the inner side tabs and outer lid side tabs are foldable against the inner lid side tabs, in the region of the second folding turret the front wall of the pack blanks facing the inside of the pockets.

Accordingly, according to the invention, the folding or production of the hinge-lid pack takes place in two successive folding turrets which can be driven continuously by virtue of their design and mode of operation. The first folding turret performs the predominant part of the folding steps. As a result of the transfer of the partially folded hinge-lid pack to the second folding turret, the relative position of the pack blanks or of the partially folded hinge-lid packs within the pockets is changed in relation to the first folding turret. It is thereby possible to complete the hinge-lid pack by a similar repetition of folding operations of the first folding turret.

At the same time, the design of the pockets of the two folding turrets is important. Each pocket of the folding turrets is assigned side folding members moveable in the radial direction. These are moved outwards from an inwardly retracted position during the rotational movement of the folding turrets, laterally projecting tabs of the pack blanks, namely inner and outer side tabs, being folded into the position suitable for packaging by coming up against the pack content or the previously folded side tabs.

During transport, regions of the pack blanks projecting laterally beyond the pockets in the axial direction are likewise folded by folding members (of fixed location) out of the extended initial position until they come up against the outer face of the pack contents. During the transfer of the partially folded hinge-lid pack to the second folding turret, essentially now only transversely projecting outer side tabs are yet to be folded. Because the hinge-lid packs in the pockets of the second folding turret are in a changed relative position obtained during the transfer, in the region of the second folding turret the outer side tabs can be folded into the final position by appropriate radially moveable side folding members.

To increase the efficiency, according to a further feature of the invention, the apparatus is designed for two-track operation, that is to say for the simultaneous production of two hinge-lid packs. Each folding turret is designed as a double turret with two turret discs on a common drive shaft.

The pack content, namely the cigarette blocks, with collar blank attached are fed to the first folding turret by a feed turret and are transferred to the pockets of the first folding turret in the correct position in relation to the pack blank.

The feed of the flat pack blanks to the first folding turret, in view of the rotational speed of the folding turret, is carried out via two blank tracks which each transfer two blanks alternately to the two pockets of the two turret disc$ arranged next to one another.

The finished hinge-lid packs, immediately after leaving the second folding turret, are transferred to a drying turret in order to stabilize the (cuboid) shape of the hinge-lid packs. In the region of the transfer of the hinge-lid packs to this drying turret, a closing strip or a strip-shaped revenue stamp is affixed to the hinge-lid pack.

Further features of the invention relate to the design of the folding turrets, the pockets of these and the transfer turret for the cigarette blocks and to the design of the drying turret.

An exemplary embodiment of the apparatus is explained in more detail below with reference to the drawings, in which:

DETAILED DESCRIPTION OF PREFERRED EMBODIMENTS

Figure 9:
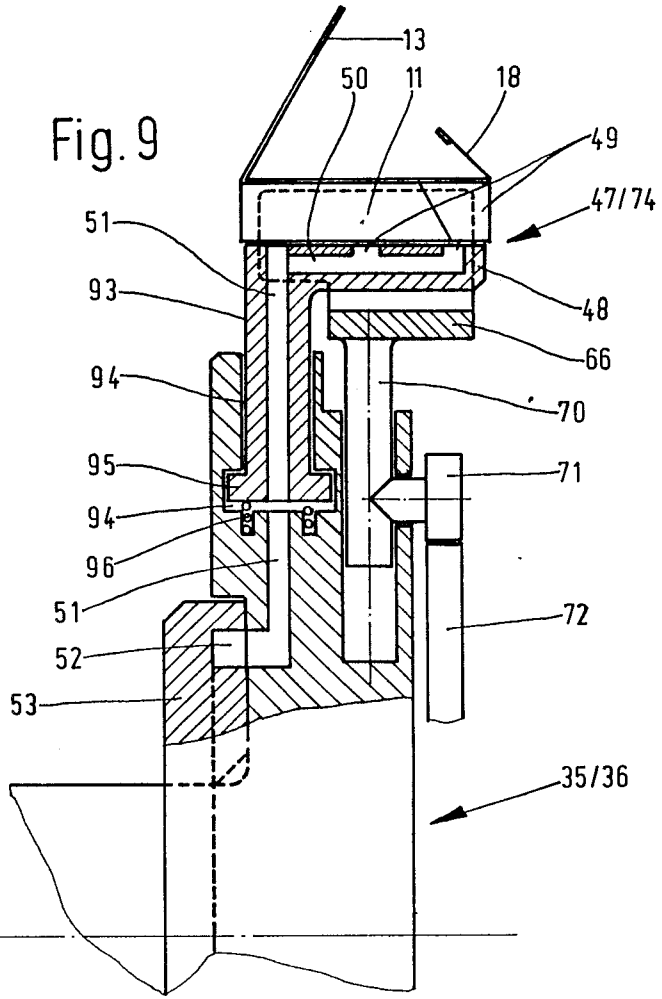
Figure 8:
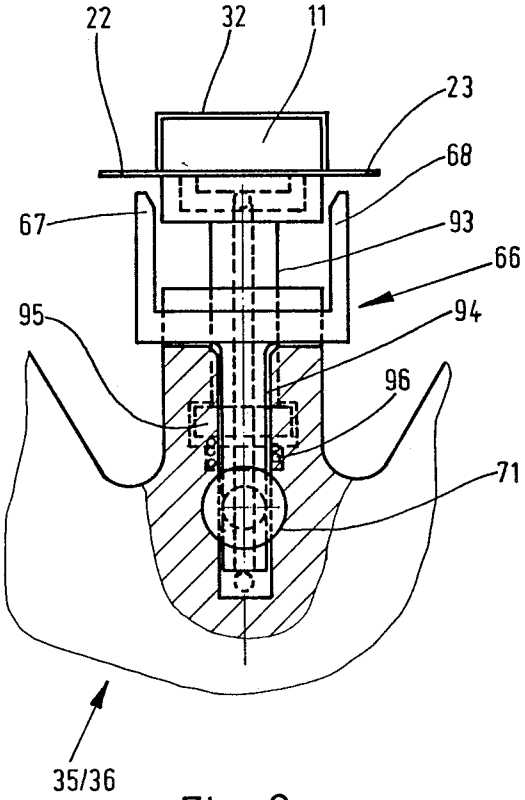
FIG. 8 shows a detail of a folding turret of another embodiment partially in transversely axial section.
Figure 10:
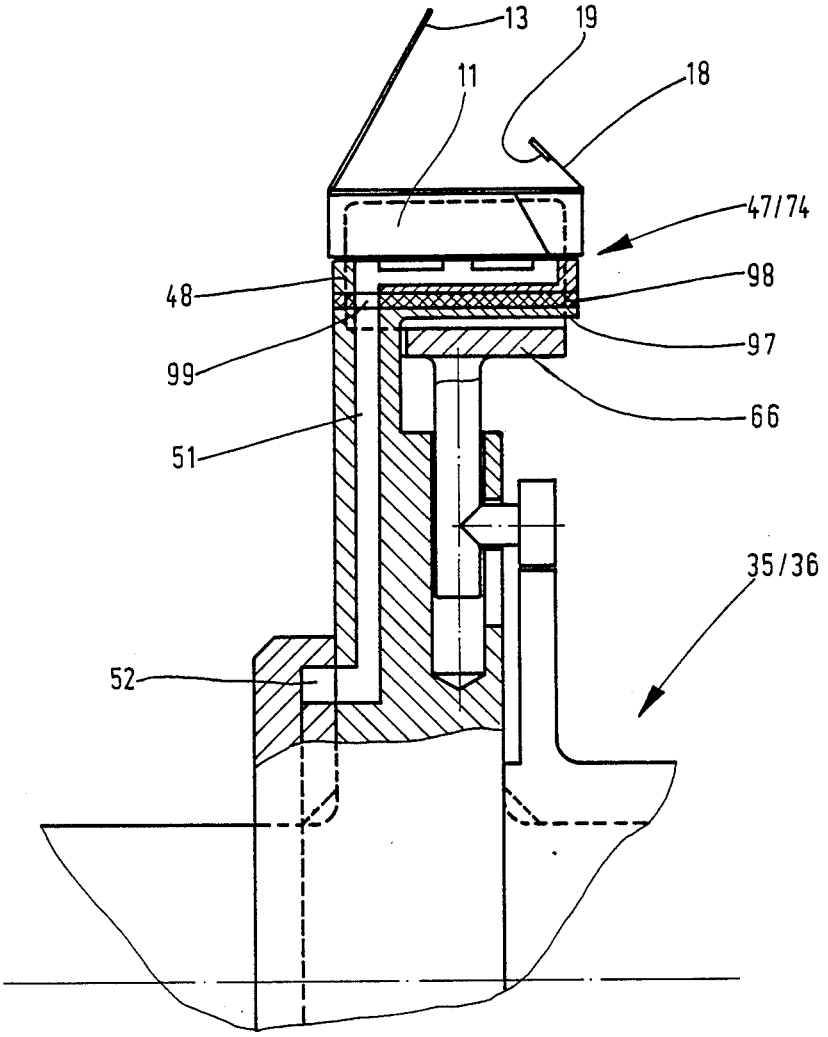

FIG. 9 shows the detail according to FIG. 8 in a section taken in the axial direction and offset 90°, FIG. 10 shows a detail, corresponding to that of FIG. 9, of a further exemplary embodiment of a folding turret.

Hinge-lid packs 10 are cuboid packs conventionally made of thin cardboard. They serve mainly for receiving cigarettes. Conventionally, a cigarette group is wrapped in an inner blank made of tin foil and is surrounded as a cigarette block 11 by the hinge-lid pack 10.

Figure 1:
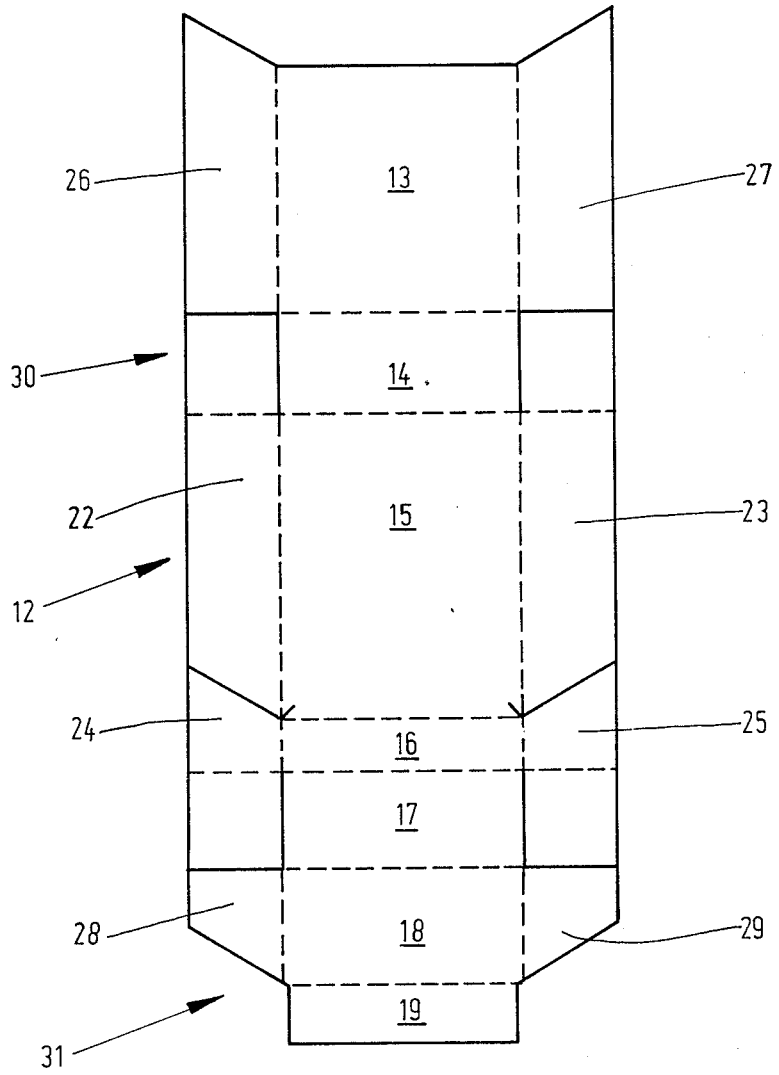
FIG. 1 shows a spread-out pack blank for the production of hinge-lid packs.

The hinge-lid pack 10 is folded from a pack blank 12 shown in a customary version in FIG. 1. Marked folding lines and punching cuts successively designate, within this pack blank 12, zones for the formation of the front wall 13, bottom wall 14, rear wall 15, lid rear wall 16, lid top wall 17 and lid front wall 18. The free side of the lid front wall 18 has adjoining it a lid inner tab 19 which, in the finished hinge-lid pack 10, is folded against the inner face of the lid front wall 18.

In order to form side walls 20 and 21 of the hinge-lid pack 10, inner side tabs 22 and 23 and inner lid side tabs 24, 25 are arranged laterally on the lid rear wall 16 and outer side tabs 26, 27 are arranged on the front wall 13, with corresponding outer lid side tabs 28, 29 on the lid front wall 18. The abovementioned side tabs are folded over one another to form the side walls 20, 21 and are connected to one another by adhesive bonding.

The hinge-lid pack 10 folded from this pack blank 12 is composed of a pack part 30 and of a hinge lid 31. The latter is connected in an articulated manner to the pack part 30 in the region of the rear wall 15 and lid rear wall 16.

The hinge-lid pack 10 also includes a collar 32 with a collar front wall 33 and collar side walls 34. The collar 32 folded in a U-shaped manner rests with a lower region in the pack part 30 and projects from this in the region of the front wall 13 and side walls 20, 21.

In the exemplary embodiment illustrated, the apparatus (packaging machine) for the production of hinge-lid lid packs 10 comprises two folding turrets 35, 36, a feed turret 37 and a drying turret 38. The hinge-lid packs 10 are folded completely in the region of the folding turrets 35 and 36. The flat pack blanks 12 are fed to the folding turret 35 which is the first in the production flow. Furthermore, cigarette blocks 11 produced elsewhere are fed, with the collar 32 attached, to the first folding turret 35. The hinge-lid packs 10 ready-folded in the region of the second folding turret 36 are transferred to the drying turret 38 and, after dimensional stabilization and the drying of glue spots, are conveyed away via a pack track 39.

A particular feature of the apparatus is that the two folding turrets 35, 36 are driven so as to run continuously. In the same way, the feed turret 37 is driven continuously at a synchronized rotational speed. In contrast, the drying turret 38 is driven intermittently.

The pack blanks 12 are fed in an approximately tangential plane to the first folding turret 35 rotating in a vertical plane. In order to conform to the performance of the folding turret 35, two blank magazines 40, 41 are assigned to this. These extend underneath the folding turrets 35, 36. The pack blanks 12 produced elsewhere are extracted successively from the blank magazines 40, 41 by so-called roll-off dispensers 42, specifically in alternation. The pack blanks 12 are then delivered to a laying-on station 45 along blank tracks 43, 44 which are arranged at an acute angle relative to one another. During transport, the pack blanks 12 pass a gluing unit 46 in the region of each of the two blank tracks 43, 44. Here, the pack blanks 12 are provided in particular regions, especially on the mutually facing sides of the side tabs 22 to 29, with glue spots for subsequent gluing together. Moreover, during transport, the lid inner tabs 19 of the pack blanks 12 are folded into their position, namely until they come up against the inner face of the lid front wall 18, by suitable conventional folding members, (so-called folding switches).

The pack blanks 12 thus prepared are each conveyed towards the radially outer side of a pocket 47 of the folding turret 35 and are received by this in a specific relative position. The pack blanks 12 each rest, with a region corresponding to the rear wall 15 and to the lid rear wall 16, that is to say to the complete rear side of a hinge-lid pack 10, against a pocket bottom 48 exposed on the outside of the folding turret 35. Regions of the pack blank 12 which are formed from the front wall 13 and bottom wall 14 on the one side and from the lid top wall 17 and lid front wall 18 on the other side project beyond the pocket 47 or the pocket bottom 48 on both sides in the axial direction. Laterally, facing the circumferential direction of the folding turret 35, the inner side tabs 22, 23 and the inner lid side tabs 24, 25 project beyond the contours of the pocket bottom 48.

In order to fix the pack blanks 12 to the pocket bottom 48 in the relative position explained above, the latter is designed as an approximately rectangular block or as a rectangular plate of the dimensions of the above-described surface regions of the pack blank 12 and is equipped with a number of distributed suction bores 49 which open onto the outer bearing surface of the pocket bottom 48. The suction bores 49 are connected, via a transversely directed manifold 50 in the pocket bottom 48 and a radially extending connecting line 51, to a suction segment 52 in the form of an arc of a circle and designed as a groove. This is arranged concentrically relative to the folding turret 35 in the region of a stationary segment disc 53. A vacuum source is connected to the suction segment 52 in a known way via lines not shown in detail. The suction segment 52 determines the range of rotation of the folding turret 35 within which the pockets 57 or the pocket bottom 48 are subjected to suction air.

The laying-on station 45 is located below an (imaginary) horizontal mid-plane of the folding turret 35. An introduction station 54 is formed directly in the mid-plane. Here, the pack content, in particular one cigarette block 11 at a time, is fed to a pocket 47, specifically during the continuous rotational movement of the folding turret 35. The cigarette block 11 is laid onto the pack blank 12 in the region of the rear wall 15 and lid rear wall 16 and is held in this position suitable for packaging.

The cigarette blocks 11 are produced outside that part of the packaging machine shown here and are transferred along a straight block track 55 to the feed turret 37 in the tangential direction. This is equipped, over its circumference, with pocket recesses 56 of small depth, each suitable for receiving one cigarette block 11. The cigarette blocks 11 are held in the pocket recesses 56 by means of suction bores 57 which are connected to a suction segment 59 of a segment disc (not shown) via radial suction lines 58 in the way already basically described. The cigarette blocks 11 are held by suction air from their reception to the introduction station 54. Located in the region of the introduction station 54 is a venting bore 60 which, via the suction line 58, respectively causes the venting of the suction bores 57 and consequently the release of the cigarette block 11.

The relative position of the folding turret 35 and feed turret 37 in relation to one another is selected so that the cigarette blocks 11 conveyed along an arc of a circle are brought, without any radial shift, in the correct position up to the pack blank 12 provided in the introduction station 54. During the further rotational movement of the folding turret 35, the cigarette block 11 enters the region of an outer holder 61 which, here, is composed of a co-rotating holding band 62 extending approximately along a quarter circle on the outer circumference of the folding turret 35. This holding band 62 is guided via two deflecting rollers 63, 64 arranged adjacent to the outer circumference of the folding turret 35. As a result of the relative position of these, a co-rotating holding strand 65 resting against the outwardly directed side of the cigarette block 11 is kept in position.

During the transport of the pack blanks 12 and cigarette blocks 11 in the region of the outer holder 61, the inner side tabs 22, 23 and the inner lid side tabs 24, 25 of the pack blanks 12 are folded. For this purpose, each pocket 47 is assigned a U-shaped side folder 66. This has two lateral folding legs 67, 68, the distance between which corresponds approximately to the width of the hinge-lid pack 10. The side folder 66 is moveable in the radial direction relative to the pocket 47 or to the pocket bottom 48. In order to fold the said side tabs 22 to 25, the side folder 66 is moved out of a retracted position, as shown, for example, by means of the pocket 47 in the introduction station 54, into an outer end position, as shown, for example, by means of the pocket at the end of the outer holder 61. During this radial movement, the folding legs 67, 68 slide along on the outside of the cigarette block 11, at the same time taking up and folding the side tabs 22, etc, until these come up against the cigarette block 11.

In this position, the side folder 66 is retracted before a transfer station 69 is reached. The latter is located on that side of :he folding turret 35 opposite the introduction station 54. Here, the partially folded pack blacks 12 together with the cigarette block 11 are transferred to the next folding turret 36.

Figure 5:
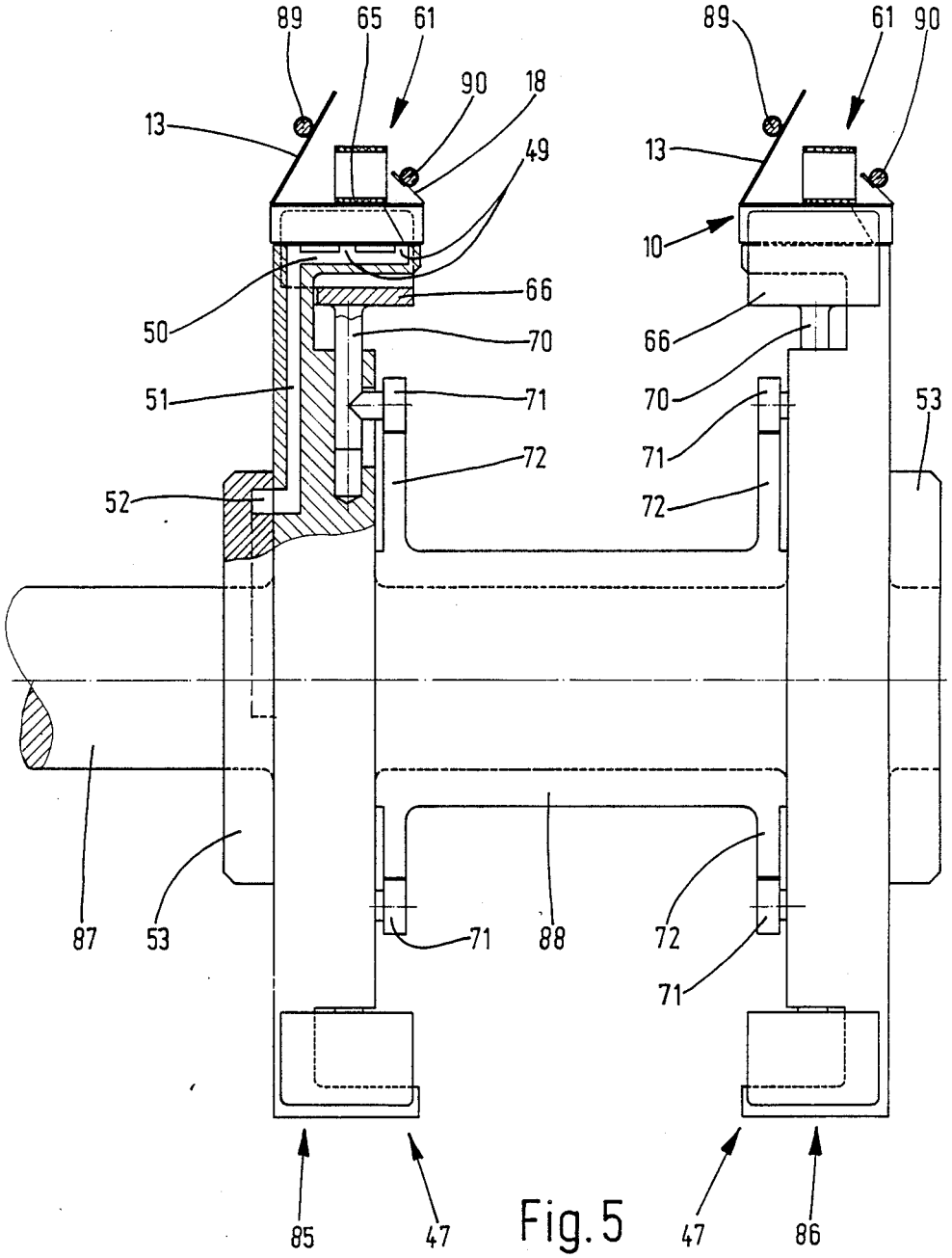
FIG. 5 shows a transversely axial view and radial section of a folding turret.
Figure 6:
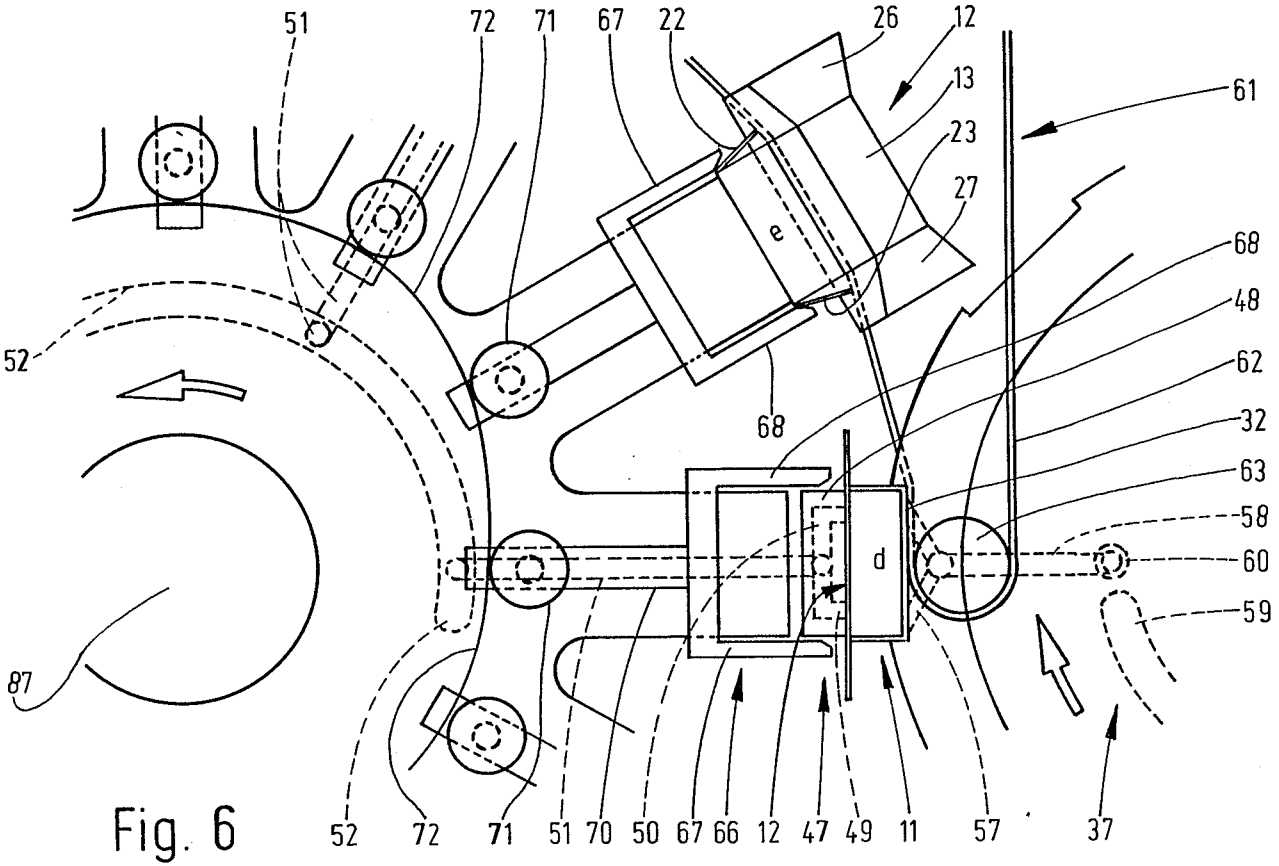
FIG. 6 shows a portion of a folding turret on an enlarged scale in a representation corresponding to that of FIG. 4.
Figure 7:
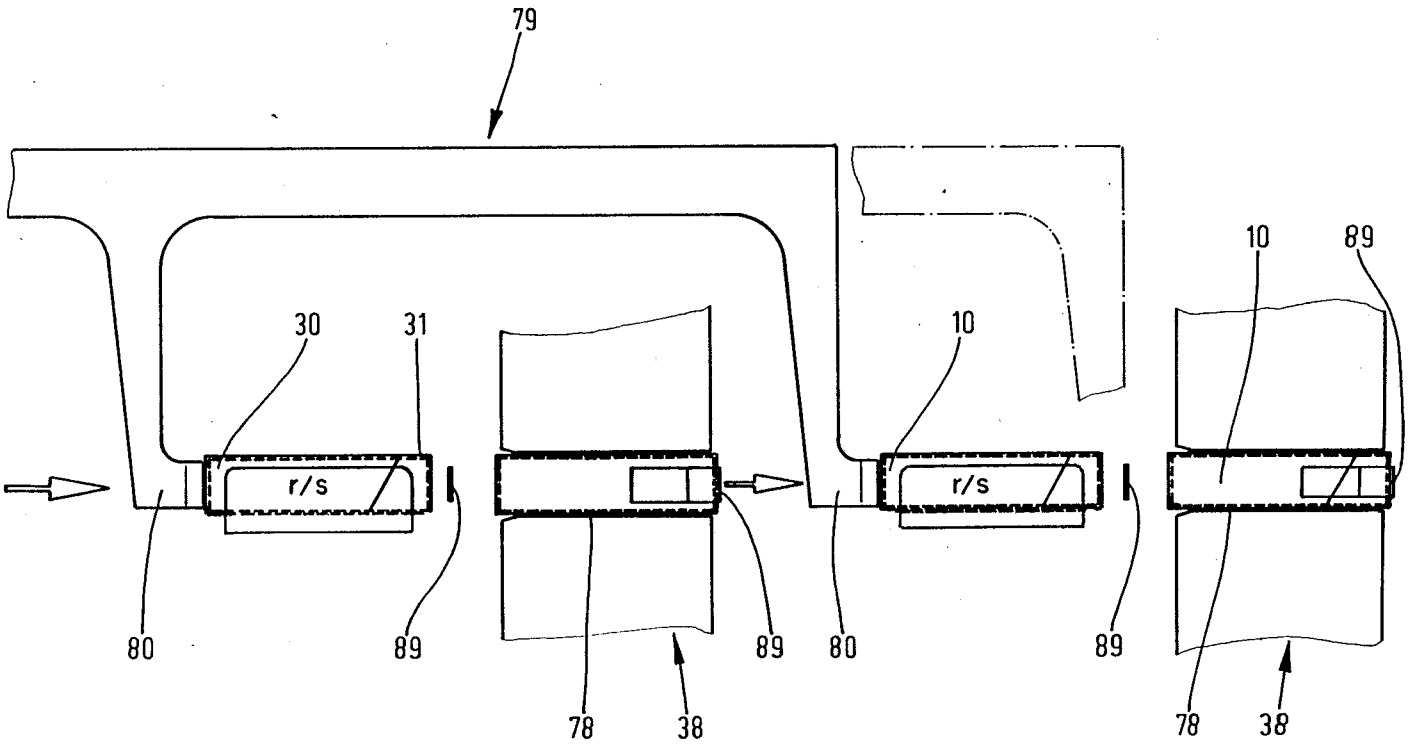
FIG. 7 shows a detail in the region of transfer of finished hinge-lid packs to a drying turret.

For executing the movements described, the side folders 66 are arranged on a radially directed actuating rod 70 (FIG. 5). This is mounted so as to be radially shiftable within a turret disc of the folding turret 35. The movements or relative positions of the actuating rod 70 are respectively determined by a tracer roller 71 which runs on a cam disc 72. The latter is shaped in such a way that, in the upper region of rotation of the folding turret 35, the actuating rods 70 together with the side folder 66 are moved outwards. In the lower region, the side folders 66 return to the initial position by means of a suitable restoring device (spring) not shown here.

During the transport of the pack blanks 12 together with the cigarette block 11 in the folding turret 35, further folding steps are carried out. As a result of the relative movement of the folding turret 35, the blank parts projecting axially on both sides of the pockets 47 are folded out of the initial position until they come up against the cigarette block 11, by means of folding members of fixed location which are known per se. In the present exemplary embodiment, these folding members are coiled folding wires 89, 90 (shown in FIG. 5) extending along the circumference of the folding turret 35.

Before the transfer station 69 is reached, the bottom wall 14 and front wall 13, on the one hand, and the lid top wall 17 and the lid front wall 18, on the other hand, rest suitably for packaging again$t the cigarette block 11, the front wall 13 and lid front wall 18 on the radially outer side of the latter. The outer side tabs (outer side tabs 26, 27, lid side tabs 28, 29) connected to the above-mentioned blank parts are in a transversely directed extended position. In this folding position, the hinge-lid packs 10 together with their content are transferred to the folding turret 36.

In the region of the transfer station 69, the suction air for the pocket bottom 48 is cut off, and instead the suction bores 49 are vented by means of a venting bore 73 formed in the segment disc 53.

The two folding turrets 35, 36 rotating in a vertical plane are so arranged relative to one another and driven that, in the transfer station 69, a particular pocket 47 of the first folding turret 35 is located exactly opposite a pocket 74 of the second folding turret 36. The pockets 74 are of the same design as the pockets 47 of the folding turret 35. The pocket bottoms 48 of the pockets 47 and 74 are located opposite one another in such a way that the hinge-lid pack 10 rests briefly against the pocket bottoms 48 of both pockets 47, 74. The pocket bottom 48 of the pocket 74 of the second folding turret 36 is under the effect of suction air, so that the unfinished hinge-lid pack 10 is now taken over by the pocket 74 and conveyed further by the second folding turret, now in the clockwise direction.

The pockets 74 are likewise equipped with side folders 66 of the design described. These serve for folding round the outer side tabs 26, 27 and the lid side tabs 28, 29 against the inner side tabs 22, 23 and against the lid side tabs 24, 25 during transport by the folding turret 36. In order to fix the hinge-lid packs 10 sufficiently in the pockets 74 during this folding operation, the transfer station 69 is followed at a circumferential distance by an outer holder 75 which is designed in a similar way to the outer holder 61 and which rests by means of the holding strand 65 against the radially outwardly directed face of the hinge-lid pack (front wall 13).

The hinge-lid packs 10 ready-folded in the way described, after leaving the region of the outer holder 75, are fed to a pushing-off station 76. This is arranged in such a way that the hinge-lid packs 10 successively cover a distance of almost 270° together with the drying turret 36. In the pushing-off station 76, the hinge-lid packs 10 are in an inclined plane against the pocket bottom 48.

Figure 4:
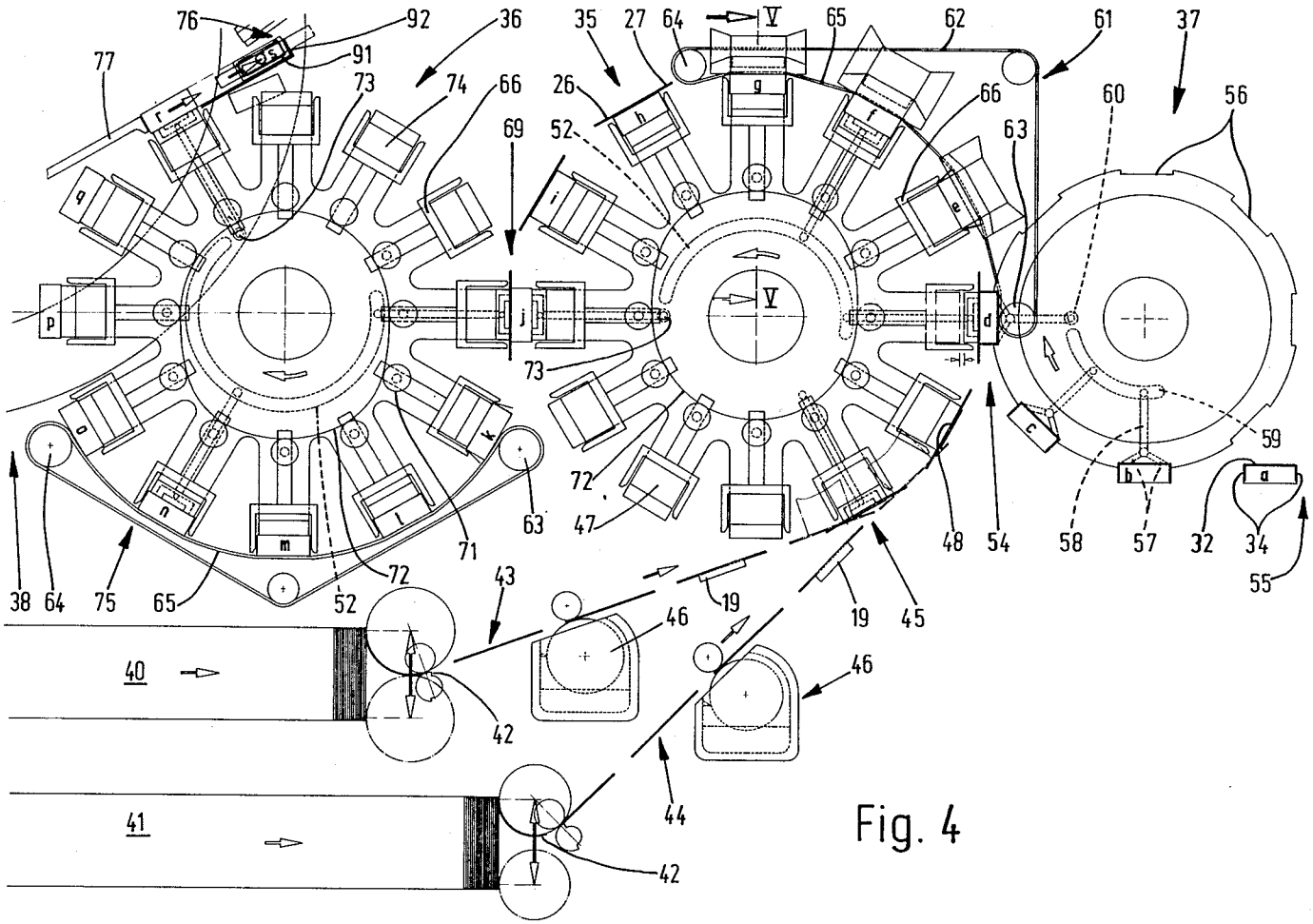
FIG. 4 shows a representation corresponding to that of FIG. 3 with details of the folding turrets.

The hinge-lid packs 10 are pushed out of this position and off from the respective pocket 74 in a tangential plane and in the direction of rotation of the folding turret 36. This purpose is served by a pusher 77 (FIG. 4) which is moveable to and fro relative to the folding turret 36 in a tangential plane. During each pushing-off movement, a finished hinge-lid pack 10 is pushed off from the pocket bottom 48 and onto an intermediate platform 91. This likewise extends in the tangential direction relative to the folding turret 36.

On the intermediate platform 91, the hinge-lid pack 10 is conveyed up to a stop 92. In this situation, the hinge-lid pack 10 is in a position aligned exactly with a pocket 78 of the drying turret 38.

The hinge-lid pack 10 is then pushed transversely into the adjacent pocket 78 during the time when the drying turret 38 is stationary.

The hinge-lid packs 10 are pushed into the drying turret 38 in this way by means of a double pusher 79 which is designed with two pusher legs 80.

During the pushing of the hinge-lid packs 10 into the drying turret 38, a strip-shaped revenue stamp 81 is affixed to the hinge-lid pack 10 on the upper end face (lid top wall 17) leading in the pushing-off direction. This revenue stamp 81 is supplied in a plane transverse relative to the direction of movement of the hinge-lid pack 10, in such a way that the revenue stamp 81 provided with glue is taken up in the correct position by the hinge-lid pack 10. At the same time, the revenue stamp 81 is folded round with an end region up again$t the side wall 20 or 21 of the hinge-lid pack 10, specifically by being pushed into the pocket 78 of the drying turret 38. The pocket 78 thereby acts as a folding mouthpiece.

Over a conveying distance of approximately 270°, the hinge-lid packs 10 remain in the intermittently driven drying turret 38. In the lower region of the latter, in particular where the pockets 78 and therefore the hinge-lid pack 10 in these are directed vertically, the hinge-lid packs 10 are initially pushed out of the drying turret 38 in an axis-parallel direction onto the pack track 39. Further transport takes place on this by means of a pushing-off device 82.

Figure 2:
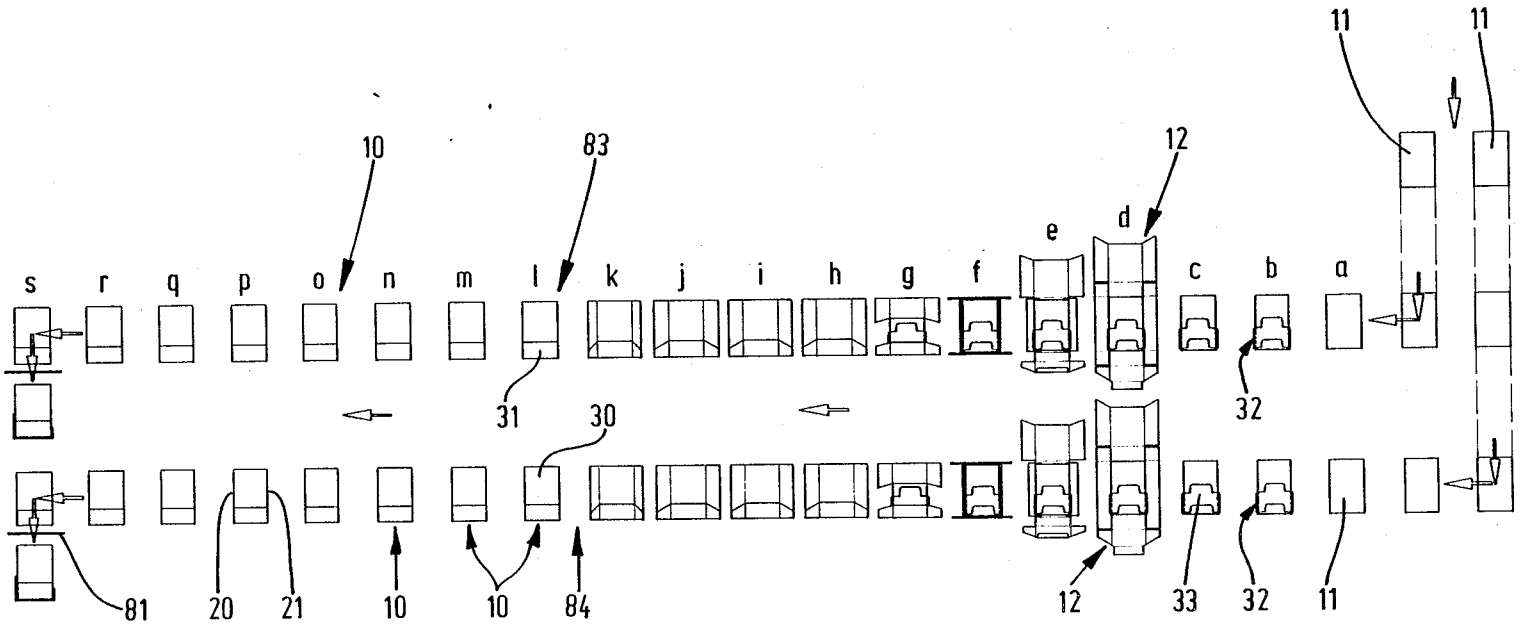
FIG. 2 shows a diagram of the flow of the folding operations by means of hinge-lid packs illustrated diagrammatically.
Figure 3:
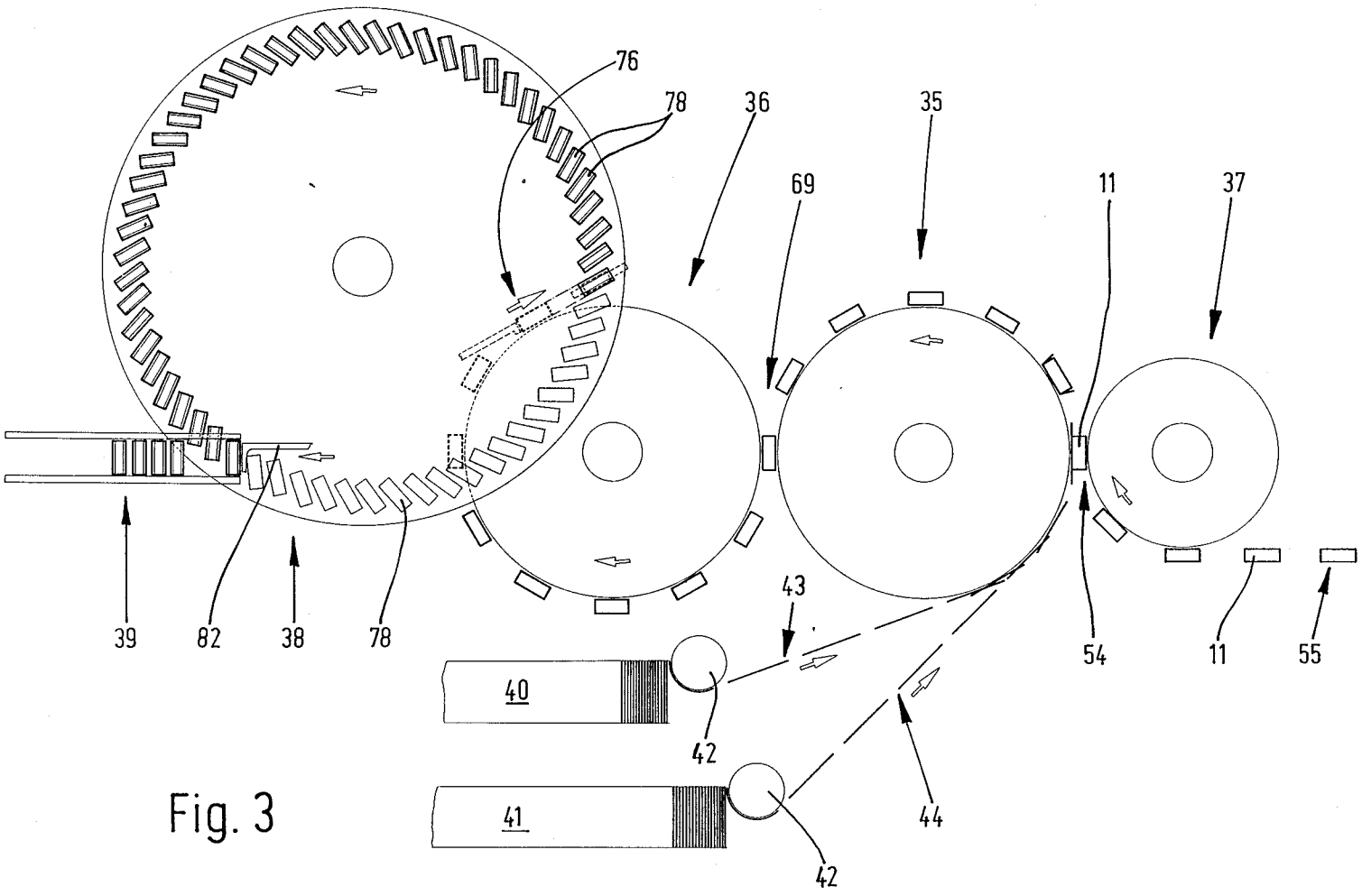
FIG. 3 shows a simplified side view of the apparatus and essential parts of this.

In order to increase or double the output, the illustrated exemplary embodiment of the packaging apparatus is designed for a two-track mode of operation. The two production tracks are shown diagrammatically in FIG. 2 in straight laid-out form.

According to this mode of production, the folding turrets 35 and 36 are designed as double turrets with two constructively and functionally identical turret discs 85 and 86. These are arranged at a distance from one another on a common turret shaft 87. The arrangement is such that the two turret discs 85, 86 are arranged laterally reversed on the turret shaft 87. This means that the actuating rods 70 for the side folders 66 are located on the mutually facing insides of the turret discs 85, 86. Correspondingly, the cam discs 72 assigned to each turret disc 85, 86 are also arranged on the mutually facing sides of the turret discs 85, 86, specifically on a common stationary supporting sleeve 88. The segment discs 53, likewise assigned to the turret discs 85, 86, of the suction-air system for the pockets 47, 48 are located on the outsides, that is to say on the sides of the turret discs facing away from one another.

The individual stages of the flow of the folding operations are represented in an identical way for the two production tracks 83, 84, the letters assigned to the positions of the hinge-lid pack 10 or the pack blank 12 matching those of the corresponding positions in the folding turrets 35, 36.

A special feature of the apparatus is the transfer of the cigarette blocks 11 or of the (partially) folded hinge-lid packs 10 from one turret to the other during the continuous movement of these. The relative position of the folding turrets 36, 37 and of the feed turret 37 in relation to one another is such that the respective cigarette blocks 11 or partially folded hinge-lid packs 10 are transferred from one pocket to the other in continuation of a conveying path in the form of an arc of a circle, without any transversely or axially directed relative movement. The distance between the pockets 47 or 74 and the pocket recesses 56 in the region of the introduction station 54 and in the region of the transfer station 69 is such that the cigarette blocks 11 or hinge-lid packs 10 are suitably received between respective adjacent pockets or adjacent pocket bottoms 48. The transfer is made possible by cancelling the suction air on one side and generating it on the other side.

In order to prevent constraints and pressures on the cigarette blocks 11 or hinge-lid packs 10 during the transfer of these, the pockets 47 and 74 of the folding turrets 35 and 36 can be designed in the way shown in FIGS. 8 to 10.

According to FIGS. 8 and 9, the pocket bottom 48 as a whole is mounted so as to be radially moveable, in such a way that, during the movement of the cigarette blocks 11 or hinge-lid packs 10 into the transfer position, a slight radial movement of the pocket bottom 48 of one or of both pockets 47, 74 takes place. For this purpose, the pocket bottom 48 i$ attached to an axially directed and shiftably mounted ram 93, specifically as a transversely projecting off-center leg (FIG. 9). The ram 93 is mounted in a corresponding recess 94 so as to be shiftable in the radial direction of the folding turret 35, 36. A lower or inner supporting end 95 widened in a piston-like manner rests on a compression spring 96. Radially directed shifts of the ram 93 and consequently of the pocket bottom 48 are possible counter to the load exerted by this. The necessary movements are executed automatically by the cigarette block 11 or the hinge-lid pack 10 in the region of the introduction station 54 or transfer station 69. At the moment of transfer, the cigarette blocks 11 or hinge-lid packs 10 rest over their entire surface against the pocket bottoms 48 of the two pockets 47 and 74.

The connecting line 51 of the suction-air system of the pockets 47, 74 is guided through the ram 93 in the longitudinal direction or radial direction.

An alternative to this solution is shown in FIG. 10. Here too, the pocket bottom 48 is shiftable slightly in the radial direction of the folding turret 35, 36. For this purpose, the pocket bottom 48 is divided in a radially inner region. An inner supporting wall 97 receives an outer part of the pocket bottom 48, with an elastically deformable supporting layer 98 interposed. The latter is made of rubber or plastic and is connected by vulcanization, adhesive bonding or the like to the mutually facing sides of the parts of the pocket bottom 48, that is to say to the supporting wall 97 and to the remaining part. Here too, in the region of transfer of cigarette blocks 11 or hinge-lid packs 10, a slight radial shift of the pocket bottom 48 of the two pockets 47, 74 occurs automatically, the elastic supporting layer 98 thereby being compressed. To provide the continuous connecting line 51 of the suction-duct system, the supporting layer 98 is equipped with a bore 99 as part of the connecting line 51.

What is claimed is:

1. In an apparatus for producing hinge-lid packs, especially for cigarettes, from a pack blank which is foldable around a cigarette block during transport in a generally circular path by rotating folding turrets; said pack blanks together with said cigarette block, being held in radially extending pockets of a folding turret; said pack blanks being foldable by means of folding members of fixed location connected to said folding turret, whereby said folding members fold blank portions against said cigarette block; said blank portions being in the form of inside side tabs and outside side tabs; the inside side tabs being folded against the cigarette block in a first step, and then the outside side tabs being folded against the inside tabs in a second step; first and second successive said folding turrets being provided for carrying out these first and second folding steps; the improvement wherein said folding members comprise: side folders (66) assigned to said pockets (47, 74) of each said folding turret (36, 36), said side folders (66) functioning to fold said inside side tabs (22, 23; 24, 25) and said outside side tabs (26, 27; 28, 29); and means for moving said side folders (66) in a radial direction relative to said pack blank (12) during the rotational movement of said folding turrets (35, 36).

2. The apparatus as claimed in claim 1, wherein said side folders (66) have two lateral folding legs (67, 68) which fold blank tabs (18, 19; 22, 23; 24, 25; 26, 27) through 90° to form pack side walls (20, 21) as a result of radially outwardly directed movement of a side folder (66), and whereby the distance between said folding legs (67, 68) corresponds approximately to the width of a hinge-lid pack (10).

3. The apparatus as claimed in claim 1, wherein a partially folded hinge-lid pack (12) rests against a pocket bottom (48) of a pocket (47, 74) during transport by a folding turret (35, 36), said folder (66) being radially movable relative to the stationary pocket bottom (48).

4. The apparatus as claimed in claim 3, wherein said side folder (66) is radially upwardly movable back into an initial retracted position in which said pocket bottom (48) of said pockets (47, 74) is directed outwards to form a free resting surface for said hinge-lid pack (10).

5. The apparatus as claimed in claim 4, further comprising means for conveying non-folded pack blanks (12) up to said folding turret (35); said conveying means comprising a blank track (43, 44) for conveying the non-folded pack blanks (12) to said folding turret (35) in a direction tangential thereto until they come to rest against a pocket bottom (48) of a pocket (47).

6. An apparatus as claimed in claim 5, comprising two blank tracks (43, 44) extending at an acute angle relative to one another, for alternately conveying pack blanks (12) to said folding turret (35).

7. An apparatus as claimed in claim 5, further comprising, in an introduction station (54) means for laying one cigarette block (11) at a time in a position against a pack blank (12) of a pocket (47), and for fixing the pack blank in said position during further transport by the folding turret (35).

8. An apparatus as claimed in claim 7, further comprising guide means for holding the cigarette block (11) in said position resting against the pack blank (12), said guide means being of fixed location extending over some of the circumference of the folding turret (35); said guiding means comprising an arcuate outer holder (61) having a co-rotating holding band (62) with a holding strand (65) resting against an outwardly facing side of the cigarette block (11).

9. An apparatus as claimed in claim 3, further comprising: means for transferring a partially folded hinge-lid pack (10) in the first folding turret (35) to the second folding turret (36) by causing the hinge-lid pack to come up against the pocket bottom (48) of a pocket (74) of the second folding turret, the distance between the pocket bottoms (48) in the region of a transfer station (69) corresponding approximately to the dimension of the hinge-lid pack (10); and means for contrarotatingly driving the two successive folding turrets (35, 36) so that said folding turrets (35, 36) continuously rotate during transfer of the partially folded hinge-lid pack (10) in the transfer station (69).

10. An apparatus as claimed in claim 9, further comprising spring means (96, 98) for elastically shifting the pockets (47, 74) of the folding turret (35, 36) in the radial direction, a pocket bottom (48) of each pocket being supported on said spring means.

11. An apparatus as claimed in claim 5, further comprising: a drying turret (38) having pockets (78); means for pushing a folded hinge-lid pack (10) from the pocket bottom (48) in a tangential plane when said side folder (66) is retracted, and for introducing the hinge-lid pack into a pocket (78) of said drying turret (38).

12. An apparatus as claimed in claim 11, further comprising means for affixing a revenue stamp (81) to that end face of the hinge-lid pack (10) leading in the direction of movement when a hinge-lid pack (10) is pushed into the pocket (78) of the drying turret (38).

13. An apparatus as claimed in claim 1, wherein, for providing a two-track mode of operation, each folding turret (35, 36) comprises a double turret having two identical turret discs (85, 86) arranged on a common turret shaft (87).

14. The apparatus as claimed in claim 4, further comprising: a drying turret (38) having pockets (78); means for pushing a folded hinge-lid pack (10) from the pocket bottom (48) in a tangential plane when said side folder (66) is retracted, and for introducing the hinge-lid pack into a pocket (78) of said drying turret (38); and holding means for holding a revenue stamp (81) transverse to the pushing-in direction of said hinge-lid pack (10) into the pocket (78) of the drying turret (38) so that, by means of the pushing-in movement of said hinge-lid pack (10) into said pocket (78), said revenue stamp (81) is affixed to that end face of the hinge-lid pack (10) which is leading in the direction of said movement.

15. In an apparatus for producing hinge-lid packs, especially for cigarettes, from a pack blank which is foldable around a cigarette block during transport by rotating folding turrets, said pack blanks together with said cigarette block each being held in pockets of a folding turret and being foldable by means of folding members of fixed location connected to said folding turret, non-folded pack blanks (12) being conveyable up to said folding turret (35), the improvement comprising at least one blank track (43, 44) for conveying the non-folded pack blanks (12) to said folding turret (35) in a direction tangential thereto until they come to rest against a pocket bottom (48) of a pocket (47).

16. The apparatus as claimed in claim 15, comprising two blank tracks (43, 44), extending at an acute angle relative to one another, for alternately conveying pack blanks (12) to said folding turret (35).

17. In an apparatus for producing hinge-lid packs, especially for cigarettes, from a pack blank which is foldable around a cigarette block during transport by folding turrets, the improvement for providing a two-track mode of operation, wherein each folding turret (35, 36) is a double turret comprising two identical turret discs (85, 86) arranged on a common turret shaft (87).

18. In an apparatus for producing hinge-lid packs, especially for cigarettes, from a pack blank which is foldable around a cigarette block during transport by folding turrets, said pack blanks together with said cigarette block each being held in pockets of a folding turret and being foldable by means of folding members of fixed location connected to said folding turret, the improvement comprising: means for putting the cigarette block (11) in a position, ready for being packed, resting against a pack blank (12) of a pocket (47) in the region of an introduction station (54); and guide means for holding said cigarette block in said position while being transported further by the folding turret (35), said guide means being of fixed location extending over part of the circumference of said folding turret (35), and said guide means comprising an arcuate outer holder (61, 75) which has a corotating holding band (62) and a holding strand (65) resting against an outwardly facing side of said cigarette block (11).

19. In an apparatus for producing hinge-lid packs, especially for cigarettes, from a pack blank which is foldable around a cigarette block during transport by circular folding turrets, said pack blanks together with said cigarette block each being held in pockets of a circular folding turret, the improvement comprising spring means (96, 98) for elastically shifting the pockets (47, 74) of the folding turret (35, 36) in the radial direction, a pocket bottom (48) of each pocket being supported on said spring means.

20. In an apparatus for producing hinge-lid packs, especially for cigarettes, from a pack blank which is foldable around a cigarette block during transport by folding turrets, said pack blanks together with said cigarette block each being held in pockets of a holding turret and being foldable by means of folding members of fixed location connected to said folding turret, each pocket having a pocket bottom, the improvement comprising: first and second successive folding turrets; means for transferring a partially folded hinge-lid pack (10) in the first folding turret (35) to the second folding turret (36) by causing the hinge-lid pack to come up against the pocket bottom (48) of a pocket (74) of the second folding turret, the distance between the pocket bottoms (48) in the region of a transfer station (69) corresponding approximately to the dimension of the hinge-lid pack (10); and means for contrarotatingly driving the two successive folding turrets (35, 36) so that said folding turrets (35, 36) continuously rotate during transfer of the partially folded hinge-lid pack (10) in the transfer station (69).

* * * * *